United States Patent [19]

Nakao

[11] Patent Number: 4,928,885

[45] Date of Patent: May 29, 1990

[54] NOZZLE DEVICE

[75] Inventor: Haruki Nakao, Tokyo, Japan

[73] Assignee: Nikki Co., Ltd., Tokyo, Japan

[21] Appl. No.: 331,300

[22] Filed: Mar. 31, 1989

[30] Foreign Application Priority Data

Apr. 7, 1988 [JP] Japan ..... 63-46942

[51] Int. Cl.[5] ..... A61H 33/02

[52] U.S. Cl. ..... 239/417; 239/428.5; 4/542

[58] Field of Search ..... 4/542, 544; 239/416, 239/416.5, 417, 428.5, 429, 431, 434, 434.5

[56] References Cited

U.S. PATENT DOCUMENTS

| | | | |
|---|---|---|---|
| 3,471,091 | 10/1969 | Baker | 239/416 |
| 4,542,854 | 9/1985 | Mathis | 4/542 X |
| 4,671,463 | 6/1987 | Moreland et al. | 4/542 X |

*Primary Examiner*—Andres Kashnikow

*Assistant Examiner*—William Grant

*Attorney, Agent, or Firm*—Nixon & Vanderhye

[57] ABSTRACT

A nozzle device for jetting water as hot as one can enjoy bathing in it, which is supplied under pressure from a hot water supply source, into hot water in the bathtub comprising a nozzle body provided with a nozzle opening formed at the front end of the nozzle body and through which the hot water is jetted and an inner hole through which the hot water is introduced from the hot water supply source to the nozzle opening, a means for jetting hot water passed through the nozzle opening, having a hole arranged coaxially with the nozzle opening and a passage through which air outside is introduced into the hot water passed through the nozzle opening, and a means for adjusting the amount of the air introduced through the air passage into the hole, said means being movable toward said nozzle opening while rotating around its axis.

4 Claims, 1 Drawing Sheet

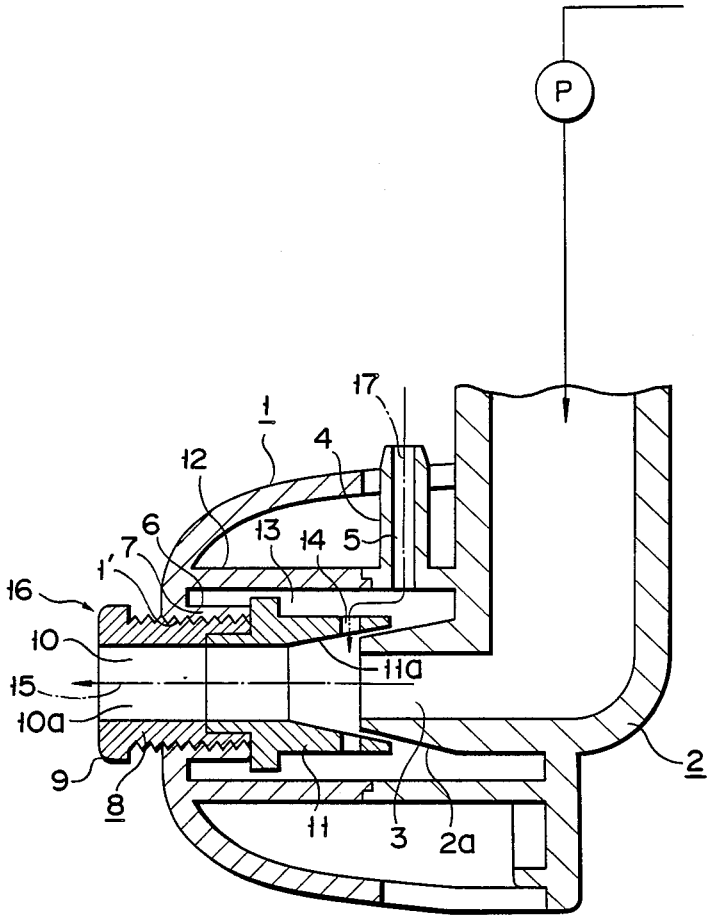
P
17
1
4
12
6
13
14
5
7
1'
16
10
11a
15
10a
2
9
8
11
3
2a

NOZZLE DEVICE

BACKGROUND OF THE INVENTION

1. Field of the Invention

The present invention relates to a nozzle device for mixing water as hot as one can enjoy bathing in it with air and jetting this mixture of hot water and air, as a jet stream, into hot water in the bathtub.

2. Description of the Related Art

The amount of mixed hot water and air jetted through the nozzle device is usually changed by varying the flow rate of hot water supplied under pressure from the pump.

In the case of changing the flow rate of hot water supplied under pressure from the pump, however, the system needs an electric control means. This makes the system complicated in construction and its cost high accordingly.

SUMMARY OF THE INVENTION

The present invention is intended to eliminate the above-mentioned drawback.

The object of the present invention is therefore to provide a nozzle device, simpler in construction and lower in cost, capable of changing the jetting pressure of hot water without varying the flow rate of the hot water.

This object of the present invention can be achieved by a nozzle device for jetting into the bathtub hot water supplied under pressure from the hot water supply source, said nozzle device comprising a nozzle body provided with a nozzle opening formed at the front end of the nozzle body and through which the hot water is jetted and an inner hole through which the hot water is introduced from the source into the nozzle opening; means for jetting hot water passed through the nozzle opening, having a hole arranged coaxially with the nozzle opening and a passage through which air outside is introduced into the hot water passed through the nozzle opening; and means for adjusting an amount of the air introduced through the passage into the hole.

The nozzle device of the present invention can jet hot water, which is supplied under pressure from the pump, through the nozzle opening at high speed and when the hot water is jetted like this through the nozzle opening at high speed, air outside is drawn into the hot water due to ejector effect so that a mixture of the hot water and the air can be jetted into hot water in the bathtub.

When the adjusting means is operated to narrow the air passage upon creating this mixture of hot water and air, the amount of air in the mixture jetted is reduced. Bubbles in the mixture jetted into the hot water in the bathtub are thus reduced, causing the viscous drag of the mixture to become large while causing the pressure of the mixture jetted to become small. When the adjusting means is operated to widen the air passage, however, the amount of air in the mixture jetted is increased. Bubbles in the mixture jetted into the hot water in the bathtub is thus increased, causing the viscous drag of the mixture to become small while causing the pressure of the mixture jetted to become large.

When the air-passage adjusting means is operated to increase or decrease the cross section of the air passage in this manner, the mixture of hot water and air jetted into the hot water in the bathtub can be adjusted to have any desired pressure.

According to the present invention, therefore, the nozzle device needs no complicated conventional means to control the rotation of a motor. This makes it possible for the nozzle device to have an extremely simpler construction to achieve the object of the present invention and for its manufacturing cost to be reduced to a greater extent.

BRIEF DESCRIPTION OF THE DRAWINGS

The drawing is a sectional view showing the main portion of an example of the nozzle device according to the present invention.

DETAILED DESCRIPTION OF THE PREFERRED EMBODIMENT

Nozzle body 2 having nozzle opening 3 through which hot water is jetted is located in the center of nozzle casing 1, directing its nozzle opening 3 left, and a hose (not shown) is connected to the base end of nozzle body 2 to communicate nozzle body 2 with the discharge outlet of pump P.

Air sleeve 4 is arranged adjacent to nozzle opening 3 of nozzle body 2 in nozzle casing 1. A hose (not shown) is connected to air sleeve 4 to introduce air in the bathroom into air passage 5 therein.

Opening 1' coaxial with nozzle opening 3 is formed in the front wall of nozzle casing 1 and sleeve 6 is horizontally projected from the circumference of opening 1' toward nozzle opening 3 of nozzle body 2. Sleeve 6 has female thread 7 on its inner face, into which operation sleeve 8 having male thread on its outer face is screwed.

The front end of operation sleeve 8 is formed as knob 9 and the outlet of hole 10 in operation sleeve 8 serves as an opening **10*a* through which a mixture of hot water and air is jetted. The front end of slide sleeve 11 is fixed integral to the base end of operation sleeve 8. The inner surface of slide sleeve 11 is tapered, becoming larger and larger in diameter as it comes nearer and nearer the nozzle opening 3, and the outer surface of that portion of nozzle body 2 in which nozzle opening 3 is formed is also tapered to have tapered surface 2*a* engageable with the inner surface or tapered surface 11*a* of slide sleeve 11. Tapered surface 11*a* of slide sleeve 11 is fitted onto the one 2*a* of nozzle body 2 to slide relative to each other in the axial direction of slide sleeve 11. These surfaces 11*a* and 2*a* may not be tapered but formed parallel to the axial line of these components. In this case, however, the outer surface of nozzle body 2 is kept face-to-face contacted with the inner surface of slide sleeve 11, enabling slide sleeve 11 to slide on the outer surface of nozzle body 2** in the axial direction thereof.

When slide sleeve 11 and nozzle body 2 are fitted each other as described above, chamber 13 is defined by partition wall 12 of nozzle casing 1 and these slide sleeve 11 and nozzle body 2, communicating with air passage 5 of air sleeve 4. Air passages 14 directed in the radial direction of slide sleeve 11 are formed at those portions of slide sleeve 11 which are adjacent to nozzle opening 3, and passage 15 extending from nozzle opening 3 to jetting opening **10*a* is communicated with air chamber 13 through air passages 14. Operation sleeve 8 is combined with slide sleeve 11 to form means 16 for adjusting air passages 14, while air passage 5, air chamber 13 and air passages 14 are communicated with one another to form air introducing passage 17**.

When pump P is rendered operative, hot water is introduced from the discharge outlet of pump P into nozzle body 2 through the hose and jetted through nozzle opening 3 at high speed, while introducing or drawing air in the bathroom into passage 15 through air passage 17. As the result, a mixture or mixed fluid of the hot water and the air is jetted into hot water in the bathtub through jetting opening 10*a*.

When knob 9 is operated to advance operation sleeve 8 together with slide sleeve 11 toward nozzle body 2, each of air passages 14 is gradually narrowed by the front end of nozzle body 2. When the cross sectional area of each of air passages 14 is made small in this manner, the amount of air introduced into passage 15 due to ejector effect is made small accordingly. The amount of air mixed with the hot water jetted is thus reduced, causing bubbles in the hot water to be reduced while causing the viscous drag of the mixed fluid jetted into hot water in the bathtub to be increased. This makes the pressure of the mixed fluid jetted small. In other words, the pressure of massage applied to the human body in the bathtub by the mixture of hot water and air jetted is made small.

When operation sleeve 8 is retreated, the cross sectional area of each of air passages 14 is made large and the amount of air introduced or drawn into passage 15 is increased accordingly. The rate of bubbles in the hot water is thus increased, causing the viscous drag of the mixed fluid jetted into hot water in the bathtub to be made small while causing the pressure of the jetting mixed fluid (or pressure of massage applied to the human body) to be increased accordingly.

According to the nozzle device of the present invention, the pressure of the mixed fluid jetted into hot water in the bathtub can be freely adjusted when knob 9 of operation sleeve 8 is operated to change the cross sectional area of each of air passages 14.

It should be understood that the present invention is not limited to the above-described embodiment and that various changes and modifications can be made without departing from the spirit and scope of the present invention.

What is claimed is:

1. A nozzle device comprising:

a nozzle body provided with a nozzle opening at a front end portion thereof for jetting hot water supplied from a hot water supply source;

a nozzle casing fixed to the nozzle body so as to circumferentially enclose said front end portion, said nozzle casing having a hole arranged coaxially with said nozzle opening; a fixed sleeve projecting inwardly from said hole toward said front end portion and having a female thread; a partition wall for partitioning the fixed sleeve and the front end portion of the nozzle body; an annular chamber enclosed by said partition wall, said fixed sleeve, and said front end portion; and an air introducing sleeve for allowing the chamber to communicate with the atmosphere;

an operation sleeve having a first end protruding from said nozzle casing, a second end received in said nozzle casing; an outer surface of said operation sleeve provided with a male thread to be engaged with said female thread of said fixed sleeve, said operation sleeve being axially movable within the fixed sleeve; and a slide sleeve having a first end connected to said second end of said operation sleeve for axial movement therewith, and a second end, at least a portion of which overlaps said front end portion of said nozzle body, said slide sleeve also formed with a radial hole communicating with said annular chamber and located adjacent to said front end portion of the nozzle body, an open area of said radial hole being controlled by said front end portion of said nozzle body when said slide sleeve is moved in an axial direction by said operation sleeve.

2. The nozzle device according to claim 1, wherein an inner surface of said slide sleeve is tapered at said second end thereof to match a tapered outer surface of said front end portion of the nozzle body, said inner surface of said slide sleeve and said outer surface of said front end portion of the nozzle body defining a space which permits said slide sleeve to be movable in said axial direction.

3. The nozzle device according to claim 1, wherein said second end of said slide sleeve is located in proximity to said front end portion of the nozzle body, and said slide sleeve is movable at its second end over said outer surface of said front end portion in said axial direction.

4. The nozzle device according to claim 1 or 3, wherein said inner surface of said second end of said slide sleeve and said outer surface of the front end portion of the nozzle body have cylindrical shapes of substantially the same diameter, and said slide sleeve is slidable at its second end over the outer surface of the front end portion in said axial direction.

* * * * *

UNITED STATES PATENT AND TRADEMARK OFFICE

CERTIFICATE OF CORRECTION

PATENT NO. : 4,928,885

DATED : May 29, 1990

INVENTOR(S) : NAKAO

It is certified that error appears in the above-identified patent and that said Letters Patent is hereby corrected as shown below:

In the title page, under item:

"[30] Foreign Application Priority Data

Apr. 7, 1988 [JP] Japan....63-46942" should read:

--63-46942(U) --

Signed and Sealed this

Nineteenth Day of May, 1992

*Attest:*

*Attesting Officer*

DOUGLAS B. COMER

*Acting Commissioner of Patents and Trademarks*